US006145128A

United States Patent [19]

Suzuki

[11] Patent Number: 6,145,128

[45] Date of Patent: Nov. 14, 2000

[54] FINGER PROTECTOR APPARATUS

[76] Inventor: Eriko Suzuki, 1-24-10 Senju-Azuma, Adachi-ku, Tokyo 120-0025, Japan

[21] Appl. No.: 09/389,305

[22] Filed: Sep. 2, 1999

Related U.S. Application Data

[60] Provisional application No. 60/100,871, Sep. 17, 1998.

[51] Int. Cl.[7] ..... A41D 13/00

[52] U.S. Cl. ..... 2/21; 294/25

[58] Field of Search ..... 2/21; D29/113; D7/543, 545; 294/25, 1.3; 401/7; 7/110

[56] References Cited

U.S. PATENT DOCUMENTS

| | | | |
|---|---|---|---|
| D. 368,330 | 3/1996 | Robinson | D29/119 |
| 1,416,001 | 5/1922 | Detwiler | 2/21 |
| 1,955,989 | 4/1934 | Uhri | 2/21 |
| 1,990,553 | 2/1935 | Koffler et al. | 2/21 |
| 2,244,072 | 6/1941 | Ledbetter | 294/25 |
| 4,454,624 | 6/1984 | Vandermer | 15/209 |
| 4,751,747 | 6/1988 | Banks et al. . | |
| 4,796,302 | 1/1989 | Davis et al. . | |
| 5,359,840 | 11/1994 | Costar | 56/400.12 |
| 5,688,181 | 11/1997 | Albert . | |
| 5,706,520 | 1/1998 | Thornton et al. . | |
| 5,749,097 | 5/1998 | Garrett-Roe . | |
| 5,848,928 | 12/1998 | Wong | 446/329 |

*Primary Examiner*—John J. Calvert
*Assistant Examiner*—Katherine Moran

[57] ABSTRACT

A finger protector apparatus includes a thumb-receiver cup portion, a flexible hinge portion connected to the thumb-receiver cup portion, and a two-finger-receiver cup portion is connected to the flexible hinge portion. A longitudinal axis extends through the thumb-receiver cup portion, the flexible hinge portion, and the two-finger-receiver cup portion. In addition, the thumb-receiver cup portion, the flexible hinge portion, and the two-finger-receiver cup portion are disposed in a plane symmetrically around the longitudinal axis. The two-finger-receiver cup portion includes interior space for receiving two fingers, one finger in a receiving space on one side of the longitudinal axis and the second finger in a receiving space on the other side of the longitudinal axis. The thumb-receiver cup portion includes an interior space for receiving a thumb along the longitudinal axis. The thumb-receiver cup portion, the flexible hinge portion, and the two-finger-receiver cup portion are made from oil-resistant material. The thumb-receiver cup portion and the two-finger-receiver cup portion can be lined with a non-slip polyurethane foam materials. The finger protector apparatus of the invention can be worn by a person who wishes to pick up oily finger foods such as potato chips. After the oily finger foods have been eaten, the person can remove the finger protector apparatus to prevent oily material from contacting devices touched by the person's fingers, such as keyboards, writing implements, and remote controls.

4 Claims, 3 Drawing Sheets

FINGER PROTECTOR APPARATUS

CROSS-REFERENCE TO RELATED APPLICATION

This application claims priority based upon my copending Provisional Application Ser. No. 60/100,871, filed Sep. 17, 1998.

BACKGROUND OF THE INVENTION

1. Field of the Invention

The present invention relates generally to devices for protecting fingers from environmental factors and, more particularly, to finger protectors especially adapted for use on a person's fingers and thumb.

2. Description of the Prior Art

Throughout the years, a number of innovations have been developed relating to devices for protecting a person's fingers from environmental factors, such as food products and high temperature items. In this respect, the following U.S. Pat. Nos. are representative of some of those finger protecting innovations: 4,751,747, 4,796,302, 5,688,181, 5,706,520, and 5,749,097. More specifically, each of the above-cited patents discloses a protector that protects a thumb and one or more fingers with protectors for individual fingers. However, there are occasions, such as when eating food products such as potato chips, where it would be desirable if a pair of fingers could fit into a single protector.

Still other features would be desirable in a finger protector apparatus. To aid in the process of gripping a food product, it would be desirable if a finger protector apparatus included a two-finger-receiver cup portion which includes an interior space for receiving two fingers, one finger in a receiving space on one side of a longitudinal axis and the second finger in a receiving space on the other side of the longitudinal axis. Moreover, to further aid in the process of gripping a food product, it would be desirable if a finger protector apparatus included a thumb-receiver cup portion which includes an interior space for receiving a thumb along the longitudinal axis.

To help prevent the finger protector apparatus from slipping off of a user's fingers, it would be desirable if a finger protector apparatus included an interior layer of foam material.

Thus, while the foregoing body of prior art indicates it to be well known to use finger protectors, the prior art described above does not teach or suggest a finger protector apparatus which has the following combination of desirable features: (1) accommodates a pair of fingers in a single protector; (2) provides a two-finger-receiver cup portion which includes an interior space for receiving two fingers, one finger in a receiving space on one side of a longitudinal axis and the second finger in a receiving space on the other side of the longitudinal axis; (3) includes a thumb-receiver cup portion which includes an interior space for receiving a thumb along the longitudinal axis; and (4) includes an interior layer of foam material. The foregoing desired characteristics are provided by the unique finger protector apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a finger protector apparatus which includes a thumb-receiver cup portion, a flexible hinge portion connected to the thumb-receiver cup portion, and a two-finger-receiver cup portion connected to the flexible hinge portion. A longitudinal axis extends through the thumb-receiver cup portion, the flexible hinge portion, and the two-finger-receiver cup portion. In addition, the thumb-receiver cup portion, the flexible hinge portion, and the two-finger-receiver cup portion are disposed in a plane symmetrically around the longitudinal axis. The two-finger-receiver cup portion includes interior space for receiving two fingers, one finger in a receiving space on one side of the longitudinal axis and the second finger in a receiving space on the other side of the longitudinal axis. The thumb-receiver cup portion includes an interior space for receiving a thumb along the longitudinal axis.

The thumb-receiver cup portion, the flexible hinge portion, and the two-finger-receiver cup portion are made from oil-resistant material. The thumb-receiver cup portion and the two-finger-receiver cup portion can be lined with a non-slip material to permit the finger protector apparatus to be used with delicate finger movements such as may be used for picking up food crumbs. In this respect, the thumb-receiver cup portion and the two-finger-receiver cup portion can be lined with a polyurethane foam material.

The finger protector apparatus of the invention can be worn by a person who wishes to pick up oily finger foods such as potato chips. After the oily finger foods have been eaten, the person can remove the finger protector apparatus to prevent oily material from contacting devices touched by the person's fingers, such as keyboards, writing implements, and remote controls.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved finger protector apparatus which has all of the advantages of the prior art and none of the disadvantages.

It is another object of the present invention to provide a new and improved finger protector apparatus which may be easily and efficiently manufactured and marketed.

It is a further object of the present invention to provide a new and improved finger protector apparatus which is of durable and reliable construction.

An even further object of the present invention is to provide a new and improved finger protector apparatus which is susceptible of a low cost of manufacture with regard to both materials and labor, and which accordingly is then susceptible of low prices of sale to the consuming public, thereby making such finger protector apparatus available to the buying public.

Still yet a further object of the present invention is to provide a new and improved finger protector apparatus which accommodates a pair of fingers in a single protector.

Still another object of the present invention is to provide a new and improved finger protector apparatus that provides a two-finger-receiver cup portion which includes an interior space for receiving two fingers, one finger in a receiving space on one side of a longitudinal axis and the second finger in a receiving space on the other side of the longitudinal axis.

Yet another object of the present invention is to provide a new and improved finger protector apparatus which includes a thumb-receiver cup portion which includes an interior space for receiving a thumb along the longitudinal axis.

Even another object of the present invention is to provide a new and improved finger protector apparatus that includes an interior layer of foam material.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
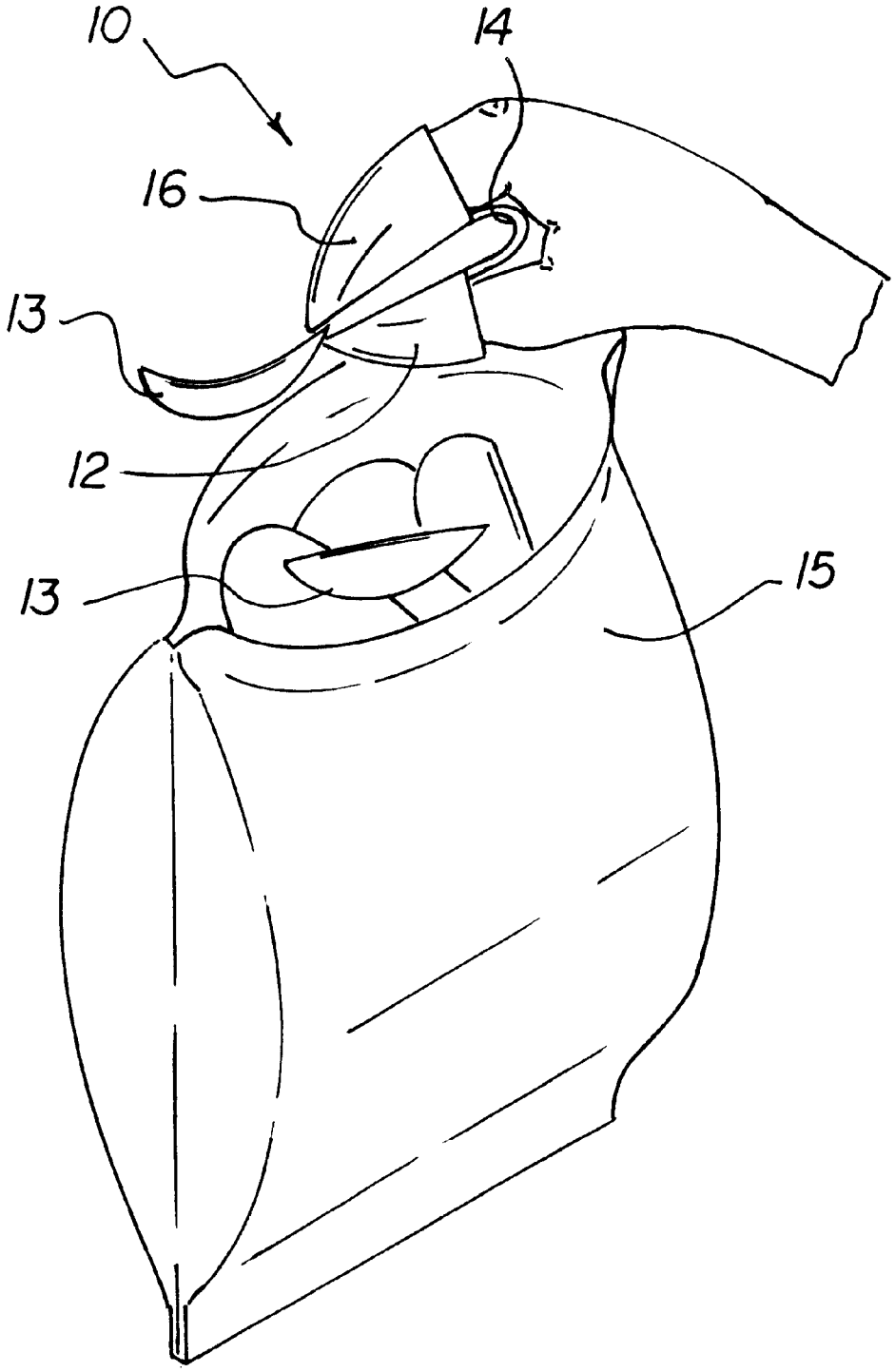
FIG. 1 is a side view showing a preferred embodiment of the finger protector apparatus of the invention in use on a person's fingers which are grasping a potato chip.

With reference to the drawings, a new and improved finger protector apparatus embodying the principles and concepts of the present invention will be described.

Turning to FIGS. 1–5, there is shown an exemplary embodiment of the finger protector apparatus of the invention generally designated by reference numeral 10. In its preferred form, finger protector apparatus 10 includes a thumb-receiver cup portion 12, a flexible hinge portion 14 connected to the thumb-receiver cup portion 12, and a two-finger-receiver cup portion 16 connected to the flexible hinge portion 14. A longitudinal axis 18 extends through the thumb-receiver cup portion 12, the flexible hinge portion 14, and the two-finger-receiver cup portion 16. In addition, the thumb-receiver cup portion 12, the flexible hinge portion 14, and the two-finger-receiver cup portion 16 are disposed in a plane symmetrically around the longitudinal axis 18. The two-finger-receiver cup portion 16 includes interior space for receiving two fingers, one finger in a receiving space on one side of the longitudinal axis 18 and the second finger in a receiving space on the other side of the longitudinal axis 18. The thumb-receiver cup portion 12 includes an interior space for receiving a thumb along the longitudinal axis 18.

The thumb-receiver cup portion 12, the flexible hinge portion 14, and the two-finger-receiver cup portion 16 are made from oil-resistant material such as plastic or metal or ivory or wood, for example. The thumb-receiver cup portion 12 and the two-finger-receiver cup portion 16 can be lined with a non-slip material to permit the finger protector apparatus 10 to be used with delicate finger movements such as may be used for picking up food crumbs. In this respect, the thumb-receiver cup portion 12 and the two-finger-receiver cup portion 16 can be lined with a polyurethane foam material.

The finger protector apparatus 10 of the invention can be worn by a person who wishes to pick up oily finger foods such as potato chips. After the oily finger foods have been eaten, the person can remove the finger protector apparatus 10 to prevent oily material from contacting devices touched by the person's fingers, such as keyboards, writing implements, and remote controls.

Figure 2:
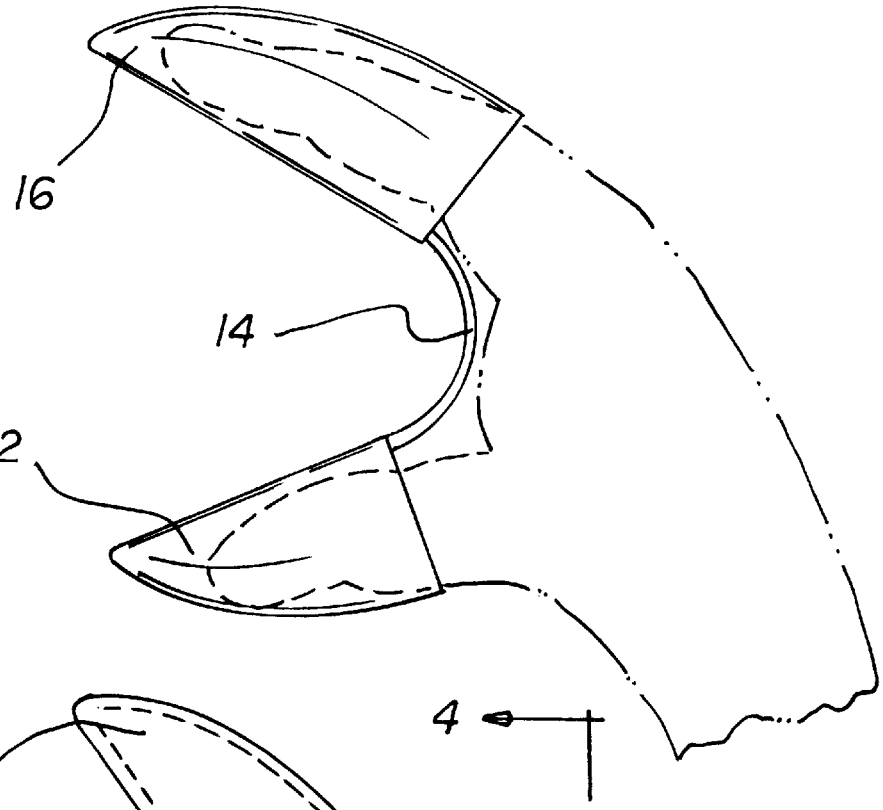
FIG. 2 is an enlarged side view of the embodiment of the finger protector apparatus shown in FIG. 1 in a open, no-grasping orientation on a person's fingers.
Figure 3:
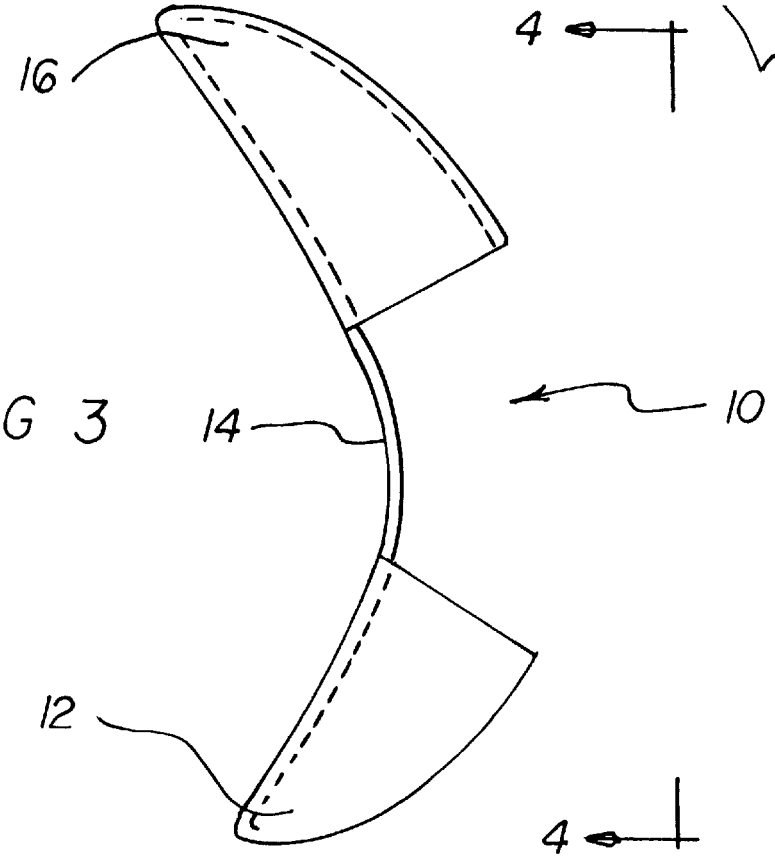
FIG. 3 is a side view of the embodiment of the finger protector apparatus of FIG. 2 removed from the person's fingers.
Figure 4:
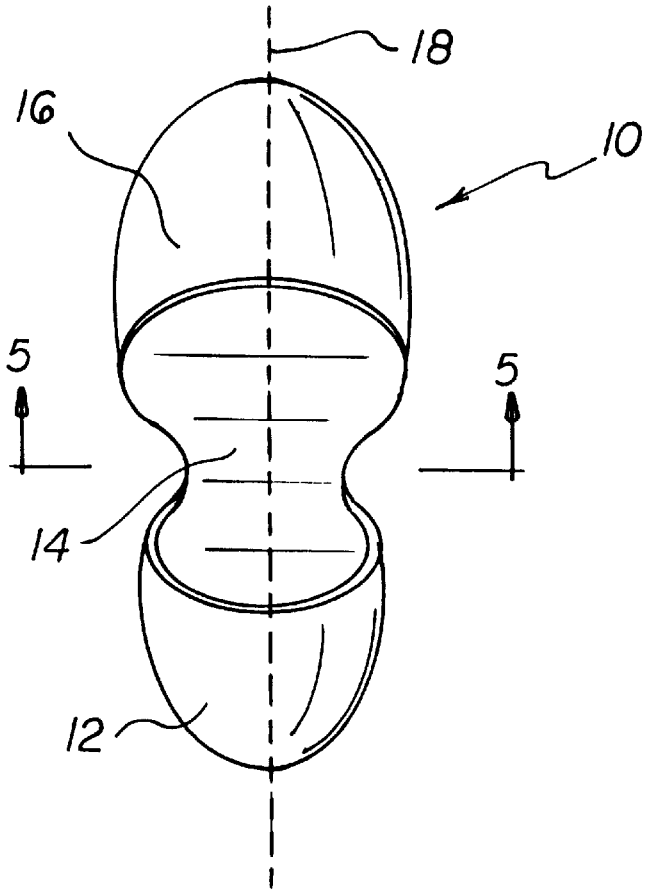
FIG. 4 is a front view of the embodiment of the invention shown in FIG. 3 taken along line 4—4 thereof.
Figure 5:
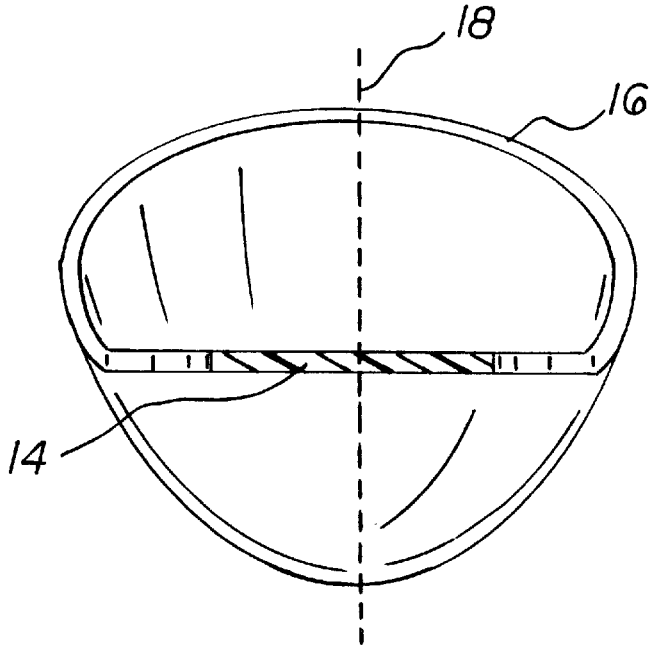
FIG. 5 is a partial cross-sectional view of the embodiment of the invention shown in FIG. 4 taken along line 5—5 thereof.

More specifically, to use the finger protector apparatus 10 of the invention, as shown in FIG. 2, the two-finger-receiver cup portion 16 receives the person's index finger and longest finger, and the thumb-receiver cup portion 12 receives the person's thumb. When the finger protector apparatus 10 is used for grasping a finger food, such as a potato chip 13 from a bag 15 containing a plurality of potato chips, the person straddles a portion of a potato chip 13 by the thumb-receiver cup portion 12 and the two-finger-receiver cup portion 16. The person moves the thumb-receiver cup portion 12 towards the two-finger-receiver cup portion 16 causing the potato chip 13 to be clamped therebetween, as shown in FIG. 1. After the potato chip 13 has been eaten, the person can open the apparatus again as shown in FIG. 2. When the person is finished eating the finger foods, the person simply removes the finger protector apparatus 10 from one's fingers and thumb. In this way, any oil that transferred from the finger food to the finger protector apparatus 10 is prevented from contacting items that are touched by the person's fingers and thumb once the finger protector apparatus 10 has been removed from the person's fingers and thumb.

The components of the finger protector apparatus of the invention can be made from inexpensive and durable metal and plastic materials or naturally occurring materials such as wood or ivory.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved finger protector apparatus that is low in cost, relatively simple in design and operation, and which may advantageously accommodates a pair of fingers in a single protector. With the invention, a finger protector apparatus provides a two-finger-receiver cup portion which includes an interior space for receiving two fingers, one finger in a receiving space on one side of a longitudinal axis and the second finger in a receiving space on the other side of the longitudinal axis. With the invention, a finger protector apparatus is provided which includes a thumb-receiver cup portion which includes an interior space for receiving a thumb along the longitudinal axis. With the invention, a finger protector apparatus is provided which includes an interior layer of foam material.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed is:

1. A finger protector apparatus, comprising:

a thumb-receiver cup portion, a flexible hinge portion connected to said thumb-receiver cup portion, and a two-finger-receiver cup portion connected to said flexible hinge portion, wherein a longitudinal axis extends through said thumb-receiver cup portion, said flexible hinge portion, and said two-finger-receiver cup portion, wherein said thumb-receiver cup portion, said flexible hinge portion, and said two-finger-receiver cup portion are disposed symmetrically around said longitudinal axis, wherein said two-finger-receiver cup portion includes interior space for receiving two fingers, one finger in a receiving space on one side of said longitudinal axis and the second finger in a receiving space on the other side of the longitudinal axis, wherein said thumb-receiver cup portion includes an interior space for receiving a thumb along said longitudinal axis, and wherein said flexible hinge portion has opposed marginal edges, said opposed marginal edges being concavely-shaped transversely with respect to said longitudinal axis to define a reduced width flexible hinge portion segment medially of said thumb-receiver cup portion and said two-finger-receiver cup portion.

2. The apparatus of claim 1 wherein said thumb-receiver cup portion, said flexible hinge portion, and said two-finger-receiver cup portion are made from oil-resistant material.

3. The apparatus of claim 1 wherein said thumb-receiver cup portion and said two-finger-receiver cup portion are lined with a non-slip material.

4. The apparatus of claim 1 wherein said thumb-receiver cup portion and said two-finger-receiver cup portion are lined with a polyurethane foam material.

* * * * *